US007144353B2

(12) United States Patent
Sjuragari

(10) Patent No.: US 7,144,353 B2
(45) Date of Patent: Dec. 5, 2006

(54) EXERCISING DEVICE

(76) Inventor: Oli H Sjuragari, Stodrvagen 6, S0-246 30 Loddekopinge (SE)

( * ) Notice: Subject to any disclaimer, the term of this patent is extended or adjusted under 35 U.S.C. 154(b) by 58 days.

(21) Appl. No.: 10/511,523

(22) PCT Filed: Apr. 11, 2003

(86) PCT No.: PCT/SE03/00585

§ 371 (c)(1),
(2), (4) Date: Oct. 15, 2004

(87) PCT Pub. No.: WO03/089068

PCT Pub. Date: Oct. 30, 2003

(65) Prior Publication Data

US 2005/0130817 A1 Jun. 16, 2005

(30) Foreign Application Priority Data

Apr. 19, 2002 (SE) ..... 0201181

(51) Int. Cl.
*A63B 26/00* (2006.01)

(52) U.S. Cl. ..... 482/142

(58) Field of Classification Search ..... 482/144–145, 482/69, 143, 35–37, 23, 121–129; D21/662
See application file for complete search history.

(56) References Cited

U.S. PATENT DOCUMENTS

D137,646 S * 4/1944 Stamm ..... D21/690
3,521,881 A 7/1970 Schaevitz
3,606,315 A * 9/1971 Green ..... 482/37
3,857,561 A 12/1974 Cecchettini et al.
4,153,244 A * 5/1979 Tauber, Jr.
4,341,378 A 7/1982 Agyagos
4,494,750 A * 1/1985 Smith
4,611,806 A 9/1986 Terry
4,638,995 A 1/1987 Wilson
4,838,250 A * 6/1989 Angelo ..... 606/237
4,850,589 A 7/1989 Block
4,921,245 A * 5/1990 Roberts
4,932,653 A 6/1990 Schwartz et al.
5,082,260 A 1/1992 Dinelli
5,221,246 A 6/1993 Torii (Continued)

FOREIGN PATENT DOCUMENTS

WO WO88/00850 2/1988

(Continued)

OTHER PUBLICATIONS

Radners Klenga, Treningsappart—Hareide Designmill.

*Primary Examiner*—Lori Amerson
(74) *Attorney, Agent, or Firm*—Fredrikson & Byron, P.A.

(57) ABSTRACT

An exercising device (10) for building strength and flexibility of muscles and other tissues, comprising a substantially vertically arranged first stand (11) for abutment against a substantially plane and horizontal underlying surface and a second stand (12), arranged in parallel with the first stand (11), for abutment against a substantially plane and horizontal underlying surface, wherein the stands (11, 12) comprise an elongated element that can be gripped by a user, which elongated element is arranged substantially horizontally and is connected to at least one element projecting towards an underlying surface. A bow (17) that can be gripped is projecting upwards from the stands (11, 12). The bow (17) comprises a first portion (18) projecting substantially vertically from the first stand (11), a second portion (20) projecting substantially vertically from the second stand (12) and a connecting portion (19) connecting the first portion (18) and the second portion (20).

18 Claims, 2 Drawing Sheets

U.S. PATENT DOCUMENTS 5,282,834 A * 2/1994 Remy ..... 606/241
5,762,593 A * 6/1998 Whiteley ..... 482/134
5,779,607 A * 7/1998 Harris ..... 482/140
5,803,880 A * 9/1998 Allen ..... 482/113
5,928,119 A * 7/1999 Dinkel ..... 482/141
6,394,932 B1 * 5/2002 Chu ..... 482/38
6,468,192 B1 * 10/2002 Doerscheln ..... 482/142
6,749,549 B1 * 6/2004 Chu ..... 482/148
2005/0059536 A1 * 3/2005 Croft ..... 482/123

FOREIGN PATENT DOCUMENTS

WO WO 8800850 * 2/1988
WO WO99/64114 12/1999

* cited by examiner

EXERCISING DEVICE

CROSS REFERENCE TO RELATED APPLICATIONS

The present application claims priority to International Application No. PCT/SE03/00585 filed 11 Apr. 2003, which in turn claims priority to Swedish Application No. 0201181.5 filed 19 Apr. 2002. The teachings of the International application and of the Swedish application are hereby incorporated into the present application by reference. The present application claims priority to both the International application and the Swedish application.

FIELD OF THE INVENTION

The present invention relates to an exercising device. More specifically the present invention relates to an exercising device for physical exercise, such as building strength and flexibility of muscles and other tissues. This type of exercising devices is commonly used for physical exercise in a home environment as well as in work out centres and health centres.

PRIOR ART

A plurality of different types of devices for physical exercise exists in the prior art. One such type of devices for exercise comprises a structure for building muscles, which structure is connected to a resistance generating means through, for example, cords or similar. Such resistance generating means generally comprises weights that can be lifted through the cords, forming a resistance when a user activates the device by muscular power. A plurality of different embodiments of this type of devices exists in the prior art, wherein different groups of muscles can be exercised.

One drawback with this type of prior art devices is that weights or similar resistance generating means are required to provide the resistance necessary for building muscles. This results in a heavy and cumbersome device having a plurality of moving parts, which leads to an increased risk for injuries when exercising and a less cost-effective structure.

One problem with this type of devices is that a plurality of different embodiments of such devices generally is required for exercising different groups of muscles. This also results in a less cost-effective structure that is unsuitable for use in, for example, a home environment or a working place.

Further one problem with such prior art exercising devices is that they often result in a more heavy type of training due to heavy loads, which can result in an increased risk of injuries. This heavier type of exercising devices is also less suitable for persons having a need for a more varied type of exercise.

Devices for exercising by means of a users own body weight to provide a resistance also exist in the prior art. One such type of device is the well-known structure for exercising the lower back muscles, usually called belly-back. A simple type of such a device generally comprises two stands arranged in parallel and projecting vertically from an underlying surface. The stands comprise a horizontal bar connected to at least one means projecting towards the underlying surface for supporting the structure. The stands can be fastened in the underlying surface and/or be connected to each other by means of bars. One belt is arranged between the stands for abutment against the front hip portion of a user and one belt is arranged between the stands for abutment against the back of the legs of the user, wherein the lower body portion of a user can be fixed horizontally in the structure while the upper portion can be brought from a vertical position to a horizontal position to activate the lower back muscles.

One drawback with this type of prior art devices is the lack of possibilities to all-round and varied training. This results in a structure that is unsuitable for use in, for example, a home environment or a working place.

One problem with this type of prior art devices is that persons having reduced or low physical capabilities, such as older and younger persons and disabled persons, hardly can use the devices for building strength and litheness.

BRIEF DESCRIPTION OF THE INVENTION

One object of the present invention is to negate above mentioned disadvantages and problems of prior art. The exercising device according to the invention will allow gentle all-round training for persons having different physical capabilities, wherein a plurality of different movements adapted to individual needs can be performed. Further, the present invention removes the need for a plurality of different devices to provide all-round training. The present invention also provides an exercising device having low weight and being well adapted for use in a home environment as well as in working places, training centres and health centres.

One additional object of the present invention is to provide an exercising device well adapted for stretching exercises in addition to building strength and flexibility. This will allow stretching of muscles and other tissues for health care purposes and/or for increased well-being.

The present invention comprises an exercising device having a first stand and a second stand arranged in parallel with the first stand. The stands may be arranged substantially vertically and may comprise a grip portion in the form of an elongated element. The stands may be formed as a square, possibly with rounded corners. For example, the stands can be formed by a tube or similar, which tube is curved to a suitable shape.

The exercising device further comprises a bow that can be gripped and which is projecting upwards from the stands. The bow is connected to the stands so that a user by means thereof can perform different types of training exercises. The bow can be arranged in a suitable angle to an underlying surface so that the bow is inclined towards the centre of the exercising device. The bow may be vertically displaceable, wherein the height of the bow can be adapted to meet the needs of individual users. For example, the bow is arranged to be received in the stands, which stands may comprise fastening means for detachable fixation of the bow at suitable height. For example the bow is also formed of a tube curved into a suitable shape.

The exercising device may also comprise a transverse bar arranged horizontally between lower portions of the stands to connect and stabilize the stands and simultaneously form a footrest. Further, the transverse bar may be arranged a distance from the underlying surface, wherein a user can put his feet under the transverse bar for support.

A base plate may be arranged between the stands to further connect the stands to each other and thus stabilize the exercising device. Further, the base plate may provide an underlayer for a user when performing different exercises at the exercising device. The base plate may be provided with a soft carpet to facilitate when performing, for example, sit-ups.

The stands, the bow, the transverse bar and the base plate may be formed in a suitable material having high strength and low weight, such as aluminium or any other metal having corresponding properties. Alternatively, suitable plastic materials can be used.

The exercising device may further comprise a support arranged between the stands for a user to utilize when performing different training exercises. The support may comprise a cushion arranged between two belts, upon which a user can sit or in any other way use for support.

Additional features and advantages of the present invention are evident from the description of embodiment examples, enclosed drawings and independent claims.

BRIEF DESCRIPTION OF THE DRAWINGS

The invention will now be described in more detail by means of exemplary embodiments and with reference to the accompanied drawings, of which

THE INVENTION

Figure 1:
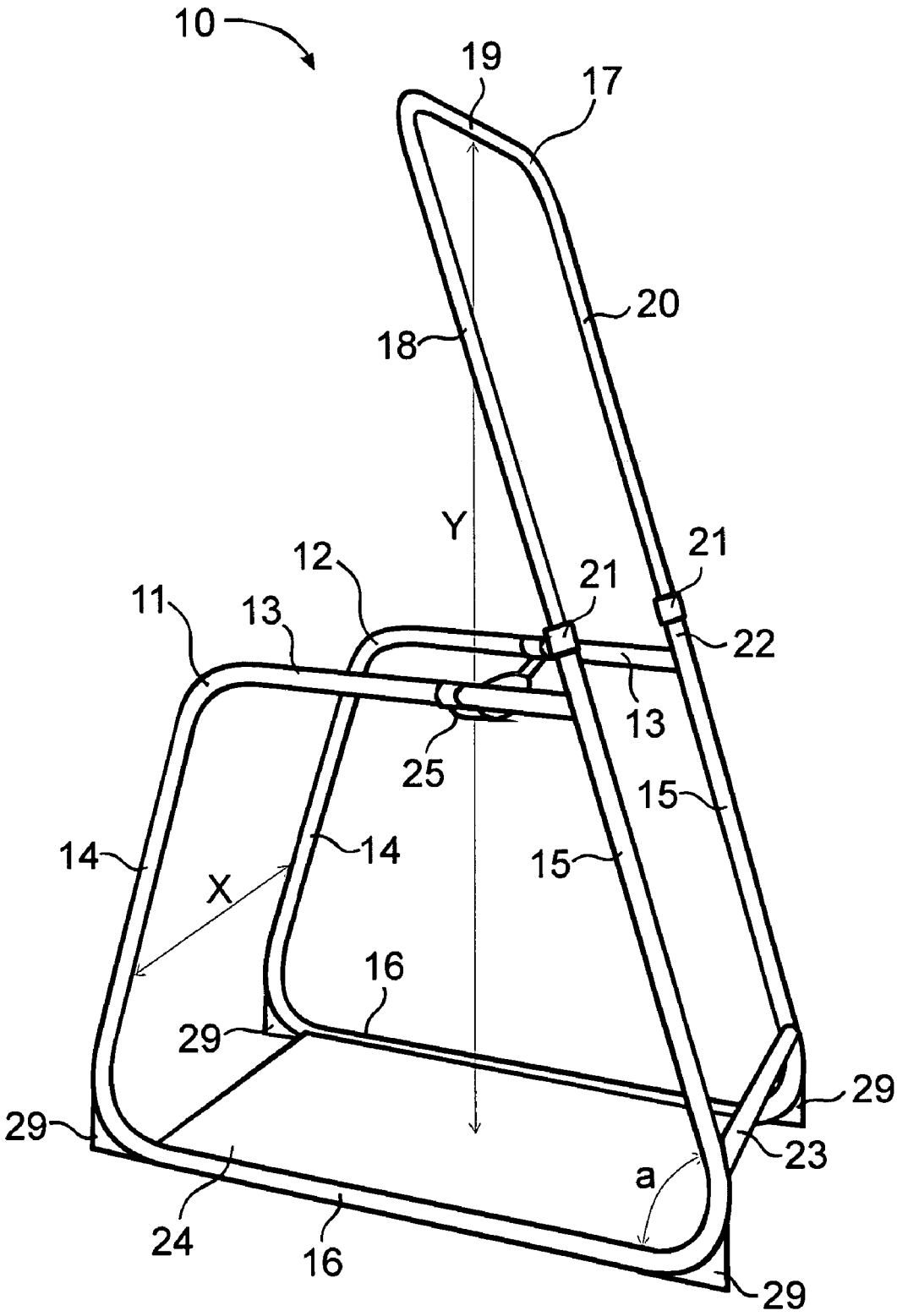
FIG. 1 is a schematic perspective view inclined from the front of an exercising device according to one embodiment of the invention.
Figure 2:
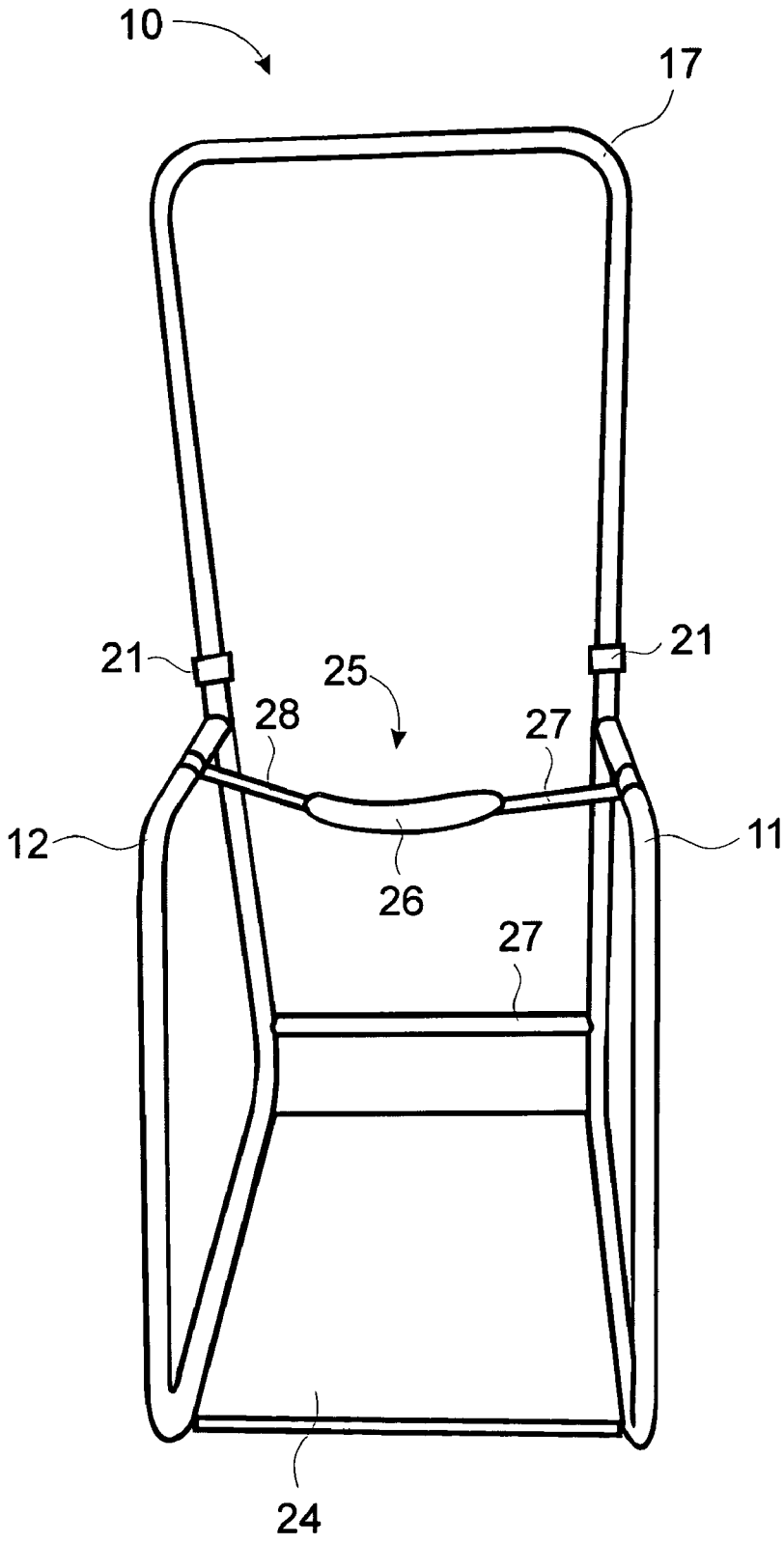
FIG. 2 is a schematic perspective view from the back of the exercising device according to FIG. 1.

In reference to FIG. 1 and FIG. 2 an exercising device 10 for all-round building of strength and flexibility of muscles and other tissues and for stretching according to one embodiment of the present invention is illustrated. The exercising device 10 comprises a substantially vertically arranged first stand 11 for abutment against an underlying surface and a second stand 12 for abutment against the underlying surface, which second stand is arranged in parallel with the first stand 11. In reference particularly to FIG. 1 the stands 11, 12 are arranged with a distance X from each other, forming a space for a user, wherein a user when exercising can be positioned between the stands 11, 12. For example, the distance X is designed so that a person tied to a wheel chair or similar can fit in the space between the stands 11, 12. According to one embodiment of the present invention the distance X is between 0.5 m and 1.2 m. For example, the distance X is about 0.6 to 0.9 m. Alternatively, the distance X is about 0.7 m.

The stands 11, 12 comprise a substantially horizontally arranged elongated element that can be gripped by a user and which is connected to at least one element projecting towards the underlying surface. For example, the stands 11, 12 comprise a first elongated element 13 that can be gripped by a user and which is arranged substantially horizontally, a second elongated element 14 projecting vertically from the first elongated element 13 and a third elongated element 15 projecting vertically from the first elongated element 13. According to the embodiments shown, the second elongated element 14 and the third elongated element 15 are further connected to a substantially horizontal fourth elongated element 16 for abutment against an underlying surface, wherein a set of the elongated elements 13–16 form one stand 11, 12. Thus, the second elongated element 14 and the third elongated element 15 support the first elongated element 13. The elongated elements 13–16 are, for example, connected to each other by their ends. For example, the stands 11, 12 are designed with a height of about 1 m, wherein the distance between the first elongated element 13 and the fourth elongated element 16, or an underlying surface, is about 1 m. According to one embodiment of the invention the height of the stands 11, 12 is about 0.9 m. For example, the fourth elongated element 16 is designed with a length of about 1.2 m, wherein a length of the exercising device 10 is about 1.2 m.

According to the embodiment of FIG. 1 the second elongated element 14 and the third elongated element 15 are inclined towards each other, wherein the third elongated element 15 is arranged in an angle a towards a horizontal plane, which plane is not illustrated in the figures, or the horizontal fourth elongated element 16. Thus, the first elongated element 13 is designed with a length shorter than the fourth elongated element 16, wherein the stands 11, 12 generally is formed as a trapezium. For example, the angle a is between 50° and 85° and suitably between 60° and 80°. Alternatively, the angle a is between 65° and 75°. According to one embodiment of the invention the angle a is about 70°.

According to one embodiment of the present invention the stands 11, 12, or the elongated elements 13–16, are formed in a material having high strength and low weight, such as metal, plastic material or any other suitable material. For example, the stands 11, 12, or the elongated elements 13–16, are formed in aluminium. For example, the stands 11, 12, or the elongated elements 13–16, are formed in tubes or similar, which tubes are curved into a suitable shape. Thus, according to one embodiment of the invention, the elongated elements 13–16 are different parts of a single tube.

The exercising device 10 further comprises a bow 17 that can be gripped by a user. The bow 17 projects substantially vertically from the stands 11, 12, wherein the bow 17 projects in a direction upwards from the stands 11, 12. The bow 17 is arranged in an angle towards a horizontal plane so that the bow 17 is inclined in a direction towards a centre of the exercising device 10. The bow 17 is displaceably and/or removably connected to the stands 11, 12 so that a height Y, see FIG. 1, of the bow 17 can be adapted to an individual person or user. Thus, the stands 11, 12 are displaceably and/or removably connected to the bow 17. For example, the bow 17 is displaceable so that the height Y between the horizontal portion 19 and the underlying surface can be adjusted between about 1 m and 2.5 m. Alternatively, the bow is displaceable to a height of about 2 m.

In reference to FIG. 1 the bow 17 comprises a first portion 18 projecting substantially vertically, a horizontal portion 19 and a second portion 20 projecting substantially vertically, wherein the bow 17 is displaceably connected to the stands 11, 12 through the first portion 18 and the second portion 20 of the bow 17. The first portion 18 of the bow 17 is connected to the third elongated element 15 of the first stand 11 and the second portion 20 of the bow 17 is connected to the third elongated element 15 of the second stand 12, wherein the bow 17 is an extension of the third elongated element 15 of the stands 11, 12. Thus, the bow 17 projects upwards in the same angle a as the third elongated element 15 of the stands 11, 12.

For example, the bow 17 is formed in a material having high strength and low weight, such as metal, plastic materials or any other suitable material. For example, the bow 17 is formed in aluminium. For example, the bow 17 is formed by a tube or similar, which tube is curved to a suitable shape. Thus, according to one embodiment of the invention, the first portion 18, horizontal portion 19 and second portion 20 of the bow 17 is different parts of a single tube.

According to one embodiment of the invention the first portion 18 and the second portion 20 of the bow 17 are designed to be introduced into the third elongated element 15 of the first stand 11 and the third elongated element 15 of the second stand 12, respectively. For example, the first portion 18 and the second portion 20 of the bow 17 are designed with a smaller diameter than the third elongated element 15 of the stands 11, 12, wherein the bow 17 is vertically adjustable. In the embodiment shown, the bow 17 is connectable to the stands 11, 12 by means of conventional fastening means 21 so that the bow 17 can be fastened at suitable height. In the embodiment shown the third elongated element 15 of the stands 11, 12 comprises an upwards projecting portion 22 provided with the fastening means 21.

The exercising device 10 further comprises a transverse bar 23 arranged between the stand 11, 12. The bar 23 is arranged substantially horizontally between a lower portion of the first stand 11 and a lower portion of the second stand 12. Suitably, the bar 23 is arranged horizontally between a lower portion of the third elongated element 15 of the first stand 11 and a lower portion of the third elongated element 15 of the second stand 12, forming a space between the transverse bar 23 and the underlying surface, wherein a user can put his feet under the transverse bar 23. For example, the transverse bar 23 is connected to the first stand 11 and the second stand 12 in a conventional manner, such as by means of a welded joint, screws or similar. For example, the transverse bar 23 is also formed of a tube in a material having high strength and low weight, such as metal, plastic materials or any other suitable material. For example the transverse bar 23 is formed in aluminium.

According to the embodiment shown the exercising device 10 comprises a substantially plane and horizontally arranged base plate 24. The base plate 24 is designed to form a suitable underlayer for a user performing different types of training exercises at the exercising device 10. For example, the base plate 10 is designed so that a user tied to a wheel chair can roll up on it. The base plate 24 is arranged between the lower portions of the stands 11, 12, wherein the base plate 24 extends from the first stand 11 to the second stand 12. Thus, a width of the base plate 24 generally corresponds to the distance between the stands 11, 12, or the distance X in FIG. 1. Further, the base plate 24 extends along the length of the stands 11, 12. The base plate 24 is arranged between the fourth elongated element 16 of the stands 11, 12, wherein the base plate 24 extends from the fourth elongated element 16 of the first stand 11 to the fourth elongated element 16 of the second stand 12. For example, the base plate abuts against the fourth elongated element 16 of the stands 11, 12 and is arranged in the longitudinal direction of the fourth elongated element 16 of the stands 11, 12. The base plate 24 generally extends from one end to the opposite end of the fourth elongated element 16 of the stands 11, 12. The base plate 24 is fastened to the stands 11, 12 by conventional means, such as by means of screws or similar. For example the fourth elongated element 16 of the stands 11, 12 comprises horizontally projecting plates having apertures for screws, not illustrated in the figures, wherein the base plate 24 can abut against the horizontally projecting plates and be fastened thereto by means of screws.

According to one embodiment of the invention the base plate 24 is provided with a carpet to obtain a soft underlayer for a user. Thus, the base plate 24 is designed to stabilize the structure and form an underlayer for a user. For example the base plate 24 comprises two aluminium sheets and a cellular structure arranged between them, wherein a stable base plate 24 having low weight is provided. Further, the carpet is, for example, fastened to the base plate 24 by means of Velcro or similar conventional means. For example, the carpet is formed in a fabric material.

In reference particularly to FIG. 2 the exercising device 10 further comprises a removable and displaceable support 25 arranged between the first stand 11 and the second stand 12, upon which support 25 a user can sit or, with any body part, lean when necessary. If required the support 25 can be removed to provide space between the stands 11, 12 when performing other training exercises. The support 25 is displaceably arranged between upper portions of the stands 11, 12. The support 25 is displaceably arranged between the first elongated element 13 of the stands 11, 12, wherein the support 25 is displaceable in a horizontal direction. For example, the support 25 comprises a cushion 26 for abutment against a user when desired. The cushion 26 is removably and adjustably connected to a first belt 27 and a second belt 28 in a conventional manner, wherein the cushion 26 is vertically adjustable by tightening or loosening the belts 27, 28. The cushion 26 is connected to the first stand 11 by means of the first belt 27 and to the second stand 12 by means of the second belt 28.

In reference to FIG. 1 the exercising device 10 according to one embodiment of the present invention comprises blocks 29 arranged at the ends of the fourth elongated element 16 of the stands 11, 12 to stabilize the exercising device 10 on an underlying surface and avoid displacement of the exercising device 10. Thus, the blocks 29 are also formed as anti-skid devices.

The exercising device 10 according to the invention thus results in that a user can perform a plurality of different training exercises, such as building strength and flexibility of different groups of muscles, by means of the own body weight and different types of stretching exercises. For example a user can grip the horizontal portion 19 of the bow 17 and pull himself upwards to perform pull-ups to activate muscles in the upper part of the back and in the arms (biceps). Due to that the bow 17 is inclined a user can perform rowing exercises by gripping the first portion 18 and the second portion 20 of the bow 17 to activate, for example, muscles in the upper part of the back, shoulders and arms (biceps). The load can be varied by the aid of the legs of the user.

Correspondingly, due to that the bow 17 is inclined a user can perform push-ups on the opposite side of the bow 17, wherein muscles in the chest, front shoulder portions and upper arms (triceps) can be activated. Further, by gripping the horizontal portion 19 of the bow 17 and bringing the lower part of the body from a vertical position to a horizontal position a user can activate lower abdominal muscles.

Further, the bow 17 is well suited for different types of stretching exercises, such as of the chest and arms by gripping the first portion 18 or the second portion 20 of the bow 17 and turn the body in a direction from the exercising device 10. By gripping the bow 17 and bringing the body downwards or backwards inter alia the upper and lower parts of the back can be stretched.

The exercising device 10 also results in good possibilities for training upper abdominal muscles due to that sit-ups advantageously can be performed on the base plate 24. Sit-ups are further facilitated by the transverse bar 23, under which a user can place his feet. Easier sit-ups can also be performed when a user is sitting on the support 25 and has the feet positioned under the transverse bar 23. Further, exercising lower back muscles, or the lumbar region, can be performed when a user places his front hip portion against the support 25 and his heels or similar against the transverse bar 23 and then brings the upper part of the body from a substantially vertical position, or a position when the upper part of the body is placed in an angle towards the lower part of the body, to a horizontal position, or a position when the upper part of the body is aligned with the lower part of the body.

Further, the upper arms (triceps) can be activated by gripping the first elongated elements 13 of the stands 11, 12 from above and bring the upper arms from a vertical position to a horizontal position and back again. The load can be varied by the aid of the legs. Correspondingly, leg muscles can be activated in a gentle manner by bringing the thighs from a vertical position to a horizontal position, wherein the arms can be used for support.

For example, the backside of the legs, the groins and the hip portion can be stretched in conventional manners by placing a foot on the support 25 while the other leg is used for support and consequently is placed on the underlying surface. For example, the front side of the thighs can be stretched when a user places his ankle against the support 25 while the other leg is used for support and consequently is placed on the underlying surface, wherein the upper portion of the users body is pushed towards the heel of the foot lying against the support 25.

Thus, the exercising device 10 can be used for training exercises and stretching exercises for a plurality of different body parts in a plurality of different manners, wherein the above-mentioned examples only are some of the exercises possible by means of the invention.

The invention claimed is:

1. An exercising device for building strength and flexibility of muscles and other tissues, comprising a substantially vertically arranged first stand for abutment against a substantially plane and horizontal underlying surface and a second stand arranged in parallel with the first stand for abutment against said underlying surface, said first and second stands comprising an elongated element that can be gripped by a user, which elongated element is arranged substantially horizontally and is connected to at least one element projecting towards said underlying surface, and a bow that can be gripped, said bow projecting upwards from the stands, and comprising a first portion projecting substantially vertically from the first stand, a second portion projecting substantially vertically from the second stand and a connecting portion connecting the first portion and the second portion, wherein the bow is arranged in an angle so that the bow is inclined towards a centre of the exercising device, and wherein the bow is connected to the stands and is displaceable so that a height of the bow is adjustable.

2. A device according to claim 1, wherein the stands are formed of a tube that is arranged in a suitable shape, and wherein the bow is displaceable into the stands.

3. A device according to claim 1, wherein the stands are formed as a trapezium.

4. A device according to claim 1, wherein the stands comprise a first elongated element that can be gripped and which is arranged substantially horizontally, a second elongated element projecting vertically from the first elongated element and a third elongated element projecting vertically from the first elongated element.

5. A device according to claim 4, wherein the stands comprise a horizontal fourth elongated element, connected to the second elongated element and the third elongated element, for abutment against an underlying surface.

6. A device according to claim 1, wherein the exercising device comprises a base plate that is arranged between the stands and forms an underlying surface for a user.

7. A device according to claim 6, wherein the stands are connected to each other through the base plate to stabilize the exercising device.

8. A device according to claim 1, wherein the exercising device comprises a removable support arranged between the stands.

9. A device according to claim 8, wherein the support comprises a cushion, which is removably and adjustably connected to the stands through belts.

10. A device according to claim 1, wherein the exercising device comprises a transverse bar arranged between the stands, forming a footrest.

11. An exercising device for building strength and flexibility of muscles and other tissues, comprising a substantially vertically arranged first stand for abutment against a substantially plane and horizontal underlying surface and a second stand arranged in parallel with the first stand for abutment against said underlying surface, said first and second stands being formed as a trapezium and comprising an elongated element that can be gripped by a user, which elongated element is arranged substantially horizontally and is connected to at least one element projecting towards said underlying surface, and a bow that can be gripped, said bow projecting upwards from the stands, and comprising a first portion projecting substantially vertically from the first stand, a second portion projecting substantially vertically from the second stand and a connecting portion connecting the first portion and the second portion, wherein the bow is arranged in an angle so that the bow is inclined towards a centre of the exercising device.

12. A device according to claim 11, wherein the stands are formed of a tube that is arranged in a suitable shape, and wherein the bow is displaceable into the stands.

13. A device according to claim 11, wherein the exercising device comprises a base plate that is arranged between the stands and forms an underlying surface for a user.

14. A device according to claim 13, wherein the stands are connected to each other through the base plate to stabilize the exercising device.

15. A device according to claim 11, wherein the exercising device comprises a removable support arranged between the stands.

16. A device according to claim 15, wherein the support comprises a cushion, which is removably and adjustably connected to the stands through belts.

17. A device according to claim 11, wherein the exercising device comprises a transverse bar arranged between the stands, forming a footrest.

18. An exercising device for building strength and flexibility of muscles and other tissues, comprising a substantially vertically arranged first stand for abutment against a substantially plane and horizontal underlying surface and a second stand arranged in parallel with the first stand for abutment against said underlying surface, said first and second stands comprising an elongated element that can be gripped by a user, which elongated element is arranged substantially horizontally and is connected to at least one element projecting towards said underlying surface, and a bow that can be gripped, said bow projecting upwards from the stands, and comprising a first portion projecting substantially vertically from the first stand, a second portion projecting substantially vertically from the second stand and a connecting portion connecting the first portion and the second portion, wherein the bow is arranged in an angle so that the bow is inclined towards a centre of the exercising device, wherein the exercising device comprises a removable support arranged between the stands.

* * * * *